US005294426A

United States Patent [19]

Sekine et al.

[11] Patent Number: 5,294,426

[45] Date of Patent: Mar. 15, 1994

[54] ELECTRORHEOLOGICAL FLUID COMPOSITIONS

[75] Inventors: Masahiro Sekine, Kitakyushu; Yasufumi Otsubo, Chiba; Shingo Katayama, Kitakyushu, all of Japan

[73] Assignee: Colloid Research Institute, Kitakyushu, Japan

[21] Appl. No.: 733,544

[22] Filed: Jul. 22, 1991

[30] Foreign Application Priority Data

Aug. 2, 1990 [JP] Japan ..... 2-203831

[51] Int. Cl.[5] ..... C01B 33/08; C01B 33/12; C10M 125/26

[52] U.S. Cl. ..... 423/335; 252/75; 252/78.3; 252/573

[58] Field of Search ..... 252/74, 73, 75, 76, 252/77, 78.1, 78.3, 572, 573; 423/335, 338; 502/8

[56] References Cited

U.S. PATENT DOCUMENTS

| | | | |
|---|---|---|---|
| 2,645,588 | 7/1953 | Barry | 252/573 |
| 3,250,726 | 5/1966 | Martinek et al. | 252/74 |
| 3,427,247 | 2/1969 | Peck | 252/74 |
| 4,339,559 | 7/1982 | McDaniel | 423/338 |
| 4,668,417 | 5/1987 | Goossens et al. | 252/74 |
| 4,775,520 | 10/1988 | Unyer et al. | 423/335 |
| 4,842,837 | 6/1989 | Shimizu et al. | 423/335 |
| 4,865,829 | 9/1989 | Hattori et al. | 423/338 |
| 4,983,369 | 1/1991 | Bardh et al. | 423/335 |

FOREIGN PATENT DOCUMENTS

| | | | |
|---|---|---|---|
| 45-10048 | 4/1970 | Japan . | |
| 48-17808 | 3/1973 | Japan . | |
| 58-32197 | 2/1983 | Japan . | |
| 58-179259 | 10/1983 | Japan . | |
| 63-185812 | 8/1988 | Japan . | |
| 1-304187 | 12/1989 | Japan | 252/74 |
| 2-34691 | 2/1990 | Japan | 252/74 |

OTHER PUBLICATIONS

Bradley et al. "Metal Alkoxides" Academic Press 1978, p. 338.

Abstract for JA 45-10048 (1970) (month unavailable).

*Journal of Applied Physics*, "Induced Fibration of Suspensions", W. M. Winslow, vol. 20, pp. 1137-1140, Dec. 1949.

*Journal of Applied Physics*, "Electroviscous Fluids. I. Rheological Properties", Donald L. Klass et al., vol. 38, No. 1, pp. 67-74, Jan. 1967.

*Journal of Applied Physics*, "Electroviscous Fluids. II. Electrical Properties", Klass et al., vol. 38, No. 1, pp. 75-80, Jan. 1967.

*Materials Science and Engineering*, "Electroheology at Small Strains and Strain Rates of Suspensions of Silica Particles in Silicone Oil", A. F. Sprecher et al., No. 95, pp. 187-197, 1987, The Netherlands.

*Journal of Colloid and Interface Science*, "Controlled Growth of Monodisperse Silica Spheres in the Micron Size Range", Werner Stober eta l., No. 26, pp. 62-69, 1968.

*International Institute for the Science of Sintering IV Round Table Meeting on Sintering*, "Preparation of Amorphous Silica Particles and Their Thermal Thermal Behavior", by Takajiro Shimohira et al., pp. 19-21, Jun, 1976.

*Primary Examiner*—Anthony McFarlane

*Attorney, Agent, or Firm*—Armstrong, Westerman, Hattori, McLeland & Naughton

[57] ABSTRACT

Electrorheological fluid compositions of this invention are dispersions in an electrically insulating medium of 10 to 50% by volume of spherical silica particles prepared by hydrolyzing a silicon alkoxide of the general formula $Si(OR)_4$ in which R is an alkyl group in the presence of an alkali catalyst and drying at or below 500° C., show excellent fluidity in the absence of an applied voltage, vary reversibly to the state of high viscosity or even to the state of gel on application of a voltage, and have good storage stability.

5 Claims, 4 Drawing Sheets

ELECTRORHEOLOGICAL FLUID COMPOSITIONS

FIELD OF THE INVENTION AND RELATED ART STATEMENT

This invention relates to electrorheological fluid compositions and, more particularly, to electrorheological fluid compositions which can change markedly in viscosity on application of a voltage, even to the state of gel completely devoid of fluidity, show excellent response to a voltage, and are potentially applicable to clutches, valves, dampers, brakes, shock absorbers, and actuators.

Electrorheological fluids, also called electroviscous fluids or electroresponsive fluids, are functional fluids, normally in the liquid state with good fluidity. On application of a high voltage, however, they increase markedly in viscosity and may finally reach the gel state with complete loss of their fluidity.

Solutions of certain polymers and suspensions of particles have been proposed for such fluids. The former, however, produce a small increase in viscosity in response to an applied voltage and do not function satisfactorily as electrorheological fluids. For this reason, studies to date have been directed mainly to the latter.

The electrorheological fluid compositions of the particle dispersion type show a relatively large increase in viscosity upon application of a voltage, namely the Winslow effect, compared with those of the polymer solution type and the following compositions are known for this category: dispersions of silica having a specified amount of silanol groups on its surface in oils [Japan Kokai Tokkyo Koho No. 45-10, 048 (1970)]; dispersions of ion exchange resins with adsorbed moisture in electrically insulating oils [Japan Kokai Tokkyo Koho No. 48-17, 806 (1973)]; dispersions of barium titanate and finely pulverized silica in electrically insulating oils [Japan Kokai Tokkyo Koho No. 58-32, 197 (1983)]; dispersions of water-containing phenolic resins in hydrophobic oils [Japan Kokai Tokkyo Koho No. 58-179, 259 (1983)]; dispersions of crystalline zeolites in electrically nonconducting fluids [Japan Kokai Tokkyo Koho No. 63-185, 812 (1988)]; and dispersions of cellulose, starch, soybean caseins, and the like in electrically insulating oils.

The known electrorheological fluid compositions cited above, however, do not change in viscosity as much as expected upon application of a voltage. It has been desirable to develop electrorheological fluids which can change in viscosity from the state of good fluidity to the state of a relatively strong gel capable of power transmission. Fluids meeting this property requirement have not been produced yet and some which can change to the state of gel on application of a voltage are thixotropic and highly viscous without sufficient fluidity in the absence of an applied voltage while others which show sufficient fluidity in the absence of an applied voltage do not gel on application of a voltage.

Fairly extensive studies have been made on electrorheological fluid compositions consisting of dispersions of silica particles, including hydrated silica such as silica gel and ultrafine anhydrous silica, in electrically insulating media and the results are reported, for example, in J. Appl. Phys., 20, 1137 (1949), J. Appl. Phys., 38, 67 (1967), J. Appl. Phys., 38, 75 (1967), and Materials Science and Engineering 95, 187 (1987). A typical example of such silica particles is silica gel, known for its wide use as desiccant, which is prepared by decomposing sodium silicate with an inorganic acid and washing the coagulated silica gel with water followed by drying and grinding.

The silica gel particles, however, present the following problem. Silica gel is a porous substance normally with a large specific surface area of 300 $m^2/g$. or more. It is therefore difficult to disperse silica gel in an oily medium to a high concentration and this, in turn, makes it difficult to produce a satisfactory electrorheological effect. Addition in high concentration of dispersing agents such as surfactants will be needed to obtain highly concentrated dispersions of silica gel particles and such addition will sometimes not only deteriorate the electrorheological effect but also cause an increase in the electrical conductivity and decreases in the moisture resistance and long-term chemical stability of the electrically insulating medium in use. Moreover, the fine silica particles in question are difficult to make by grinding and coarse particles, remaining as contaminants after the grinding, cause a problem with respect to storage stability because of their tendency to settle when dispersed. The problem of storage stability, that is, the sedimentation of particles during storage, cannot be ignored in the cases of electrorheological fluid compositions based on particle suspensions. None of the compositions known so far shows sufficient storage stability.

Another substance which has been a subject of extensive studies is ultrafine particles of anhydrous silica that is synthesized by the hydrolysis of a volatile silicon compound such as silicon tetrachloride in an oxyhydrogen flame. The particles here also have a large specific surface area and are difficult to disperse in an oily medium to high concentration. Compositions obtained by dispersing the anhydrous silica particles in an achievable concentration range which is low do not produce a satisfactory electrorheological effect.

The present inventors have undertaken extensive studies on dispersions of a variety of powdered compounds in electrically insulating media in order to solve the aforesaid problems related to the particle dispersion type electrorheological fluid compositions, found that application of silica particles synthesized in a specific manner produces a good electrorheological effect, and completed this invention.

OBJECT AND SUMMARY OF THE INVENTION

It is therefore an object of this invention to provide electrorheological fluid compositions which change sufficiently in viscosity on application of a voltage and, depending upon the conditions, can change even into gels completely devoid of fluidity and capable of power transmission.

Another object of this invention is to provide electrorheological fluid compositions which produce an excellent electrorheological effect, form practically no sediments of dispersed particles, and show good storage stability.

A further object of this invention is to provide electrorheological fluid compositions which respond to a voltage so well as to be useful for applications to clutches, valves, dampers, brakes, shock absorbers, and actuators.

This invention relates to electrorheological fluid compositions which comprise an electrically insulating medium and silica particles dispersed therein, said silica particles being prepared in spheres by hydrolyzing a silicon alkoxide of the following general formula (1)

$$Si(OR)_4 \quad (1)$$

in which R is an alkyl group in the presence of an alkali catalyst and drying at or below 500° C. and the content of the silica particles being 10 to 50% by volume.

The silica particles to be used in this invention must be spherical particles synthesized by hydrolyzing a silicon alkoxide of the general formula (1) in the presence of an alkali catalyst and drying the resulting silica particles at or below 500° C., preferably at or below 350° C.

Typical silicon alkoxides of the general formula (1) are tetramethoxysilane (R=methyl) or tetraethoxysilane (R=ethyl). Others are tetraisopropoxysilane, tetra-n-propoxysilane, and tetra-n-butoxysilane.

The hydrolysis of such silicon alkoxides in the synthesis of the spherical silica particles of this invention is made to proceed uniformly by using a suitable amount of organic solvent. The organic solvents for this purpose should preferably be miscible with water and include alcohols, ketones such as acetone and methyl ethyl ketone, and tetrahydrofuran. It is rational and practical to use the alcohol corresponding to the alkoxy group of the silicon alkoxide in use, for example, ethyl alcohol for silicon tetraethoxide.

An alkali catalyst is used in the hydrolysis of silicon alkoxides in order to raise the rate of polycondensation and synthesize spherical particles. Examples of such catalysts are alkali metal hydroxides, ammonia, and amines. Ammonia is preferable as it leaves no impurities behind and is well suited for the synthesis of spherical particles.

The aforesaid spherical silica can be synthesized according to the method of W. Stoeber and coworkers described in J. Colloid and Interface Sci., 26, 62–69 (1968) or that of Shimohira and coworkers reported in J. Japanese Society of Powder and Powder Metallurgy, 23, 137–142 (1976). The silica particles synthesized by these methods are monodisperse spherical particles in a narrow particle size distribution with an average diameter in the range from 0.1 to 2.0 μm and a geometric standard deviation of 1.2 or less. Besides, the particles are dense and show a BET specific surface area of 100 $m^2/g$. or less with nitrogen as adsorbate, said area being roughly equal to the geometric surface area calculated in consideration of the particle size distribution. The silica particles dried in the manner to be described later contain 3% or less of carbon, lose 2 to 12% of their weight, presumably adsorbed water, when heated up to 200° C. in thermogravimetric analysis, and further lose 2 to 10% of their weight, presumably residual organic matters and condensation products of silanol groups, at 200° C. to 1,000° C. This indicates that the methods mentioned above are particularly suited for the preparation of the electrorheological fluid compositions of this invention. Two or more kinds of silica particles obtained in different diameter under different conditions may be used as a mixture.

The silica particles produced by the hydrolysis in the above-mentioned manner are separated from the reaction mother liquid, dried, and dispersed into a matrix, that is, an electrically insulating medium, to provide a desired electrorheological fluid composition. Alternatively, the silica particles may be dried by replacing the reaction mother liquor with an electrically insulating medium. The former procedure is based on drying in a liquid-free state and will produce a better electrorheological effect than the latter although the particles coagulate while drying and need to be redispersed. On the other hand, the latter procedure dries the low-boiling chemical species, either used as reactants or formed as by-products in the synthesis of silica particles, in the copresence of an electrically insulating medium and provides an electrorheological fluid composition of excellent particle dispersibility although the electrorheological effect is somewhat sacrificed.

As described above, the electrorheological properties of the fluid compositions vary with the prepatory procedure employed for separating and drying the synthesized silica particles. What causes this difference is not clear at the moment, but it is possible to choose one of these procedures to meet better the property requirements of electrorheological fluid compositions. These procedures will be explained in detail below.

With the former procedure based on the separation of the silica particles from the reaction mother liquor followed by drying, the separation is effected by filtration or centrifugation of the particles or by removal of the solvent by distillation in vaccum or at ambient pressure. The particles thus separated from the reaction mother liquor must be dried at or below 500° C., preferably at or below 350° C. At a drying temperature above 500° C., an undesirable marked deterioration of the electrorheological effect occurs probably due to decreases in the content of adsorbed water and in the silanol groups on the surface.

Even when the silica particles are dried at a temperature in excess of 500° C., the particles are observed to gain weight from increases in the content of adsorbed water and the silanol groups on the surface when they are dispersed in water or left in an atmosphere of high humidity or, in extreme cases, left in the normal living environment over an extended period of time. Such silica particles will produce an electrorheological effect when dispersed in an electrically insulating medium. This means that the silica particles which were dried once above 500° C. and thereafter allowed to reabsorb water are regarded substantially the same as those dried not above 500° C. and are included in the category of particles dried at or below 500° C. specified by this invention.

The silica particles thus separated and dried are dispersed in an electrically insulating medium with the aid of a known device, for example, by a mortar, a ball mill, an attritor, and a three-roll mill.

With the latter procedure based on the replacement of the reaction mother liquor with an electrically insulating medium, the replacement is effected by adding the matrix of an electrorheological fluid composition, namely an electrically insulating medium, to the reaction mother liquor containing the silica particles formed by the hydrolysis and distilling off the mother liquor. In the cases where the mother liquor is not miscible with the electrically insulating medium, resort is made to an intermediary replacement with another medium that is miscible with both the mother liquor and the electrically insulating medium.

It is necessary to dry the silica particles at or below 500° C. even with the application of the latter procedure, preferably below the boiling point or decomposition point of the electrically insulating medium in use, or more preferably also in vacuum or in an inert atmosphere.

There is no specific limitation to the electrically insulating media to be used in this invention as long as they are electrically insulating high-boiling substances and their examples are petroleum-derived lubricants, transformer oils, silicone oils, dibutyl sebacate, chlorinated paraffins, alkyl bromides, aromatic polycarboxylic acid alkyl esters, aromatic polycarboxylic acid halophenylalkyl esters, halophenyl alkyl ethers, and fluorine-containing oils.

The silica particles are normally added to the electrically insulating medium in question in an amount of 10 to 50% by volume, preferably 15 to 45% by volume. Addition of 10% by volume or less of the silica particles causes too small changes in viscosity on application of a voltage to give a satisfactory performance as electrorheological fluid composition. On the other hand, addition in excess of 50% by volume raises the normal viscosity in the absence of an applied voltage and undesirably causes the composition to behave like a thixotropic substance.

The electrorheological fluid compositions of this invention show excellent fluidity in the absence of an applied voltage and vary even to the state of gel upon application of a voltage under certain conditions. Although the reason for this property is not clear yet, it is likely that the spherical particles prepared from silicon alkoxides are dense, not so fine as those prepared by a vapor phase process nor so coarse as those prepared by grinding, and optimal for producing the desired electrorheological effect. The particles prepared from silicon alkoxides are capable of holding adsorbed water with relative stability and this property may also be an important factor responsible for the excellent electrorheological effect of this invention.

As described above, the electrorheological fluid compositions of this invention show excellent fluidity in the absence of an applied voltage, vary reversibly to the state of high viscosity or even to the state of of gel on application of a voltage, and have good storage stability as evidenced by the absence of degradation of the product quality such as sedimentation of particles. They are hence useful industrial materials with potential applicability to clutches, valves, dampers, brakes, shock absorbers, and actuators.

DETAILED DESCRIPTION OF THE PREFERRED EMBODIMENTS

Figure 1:
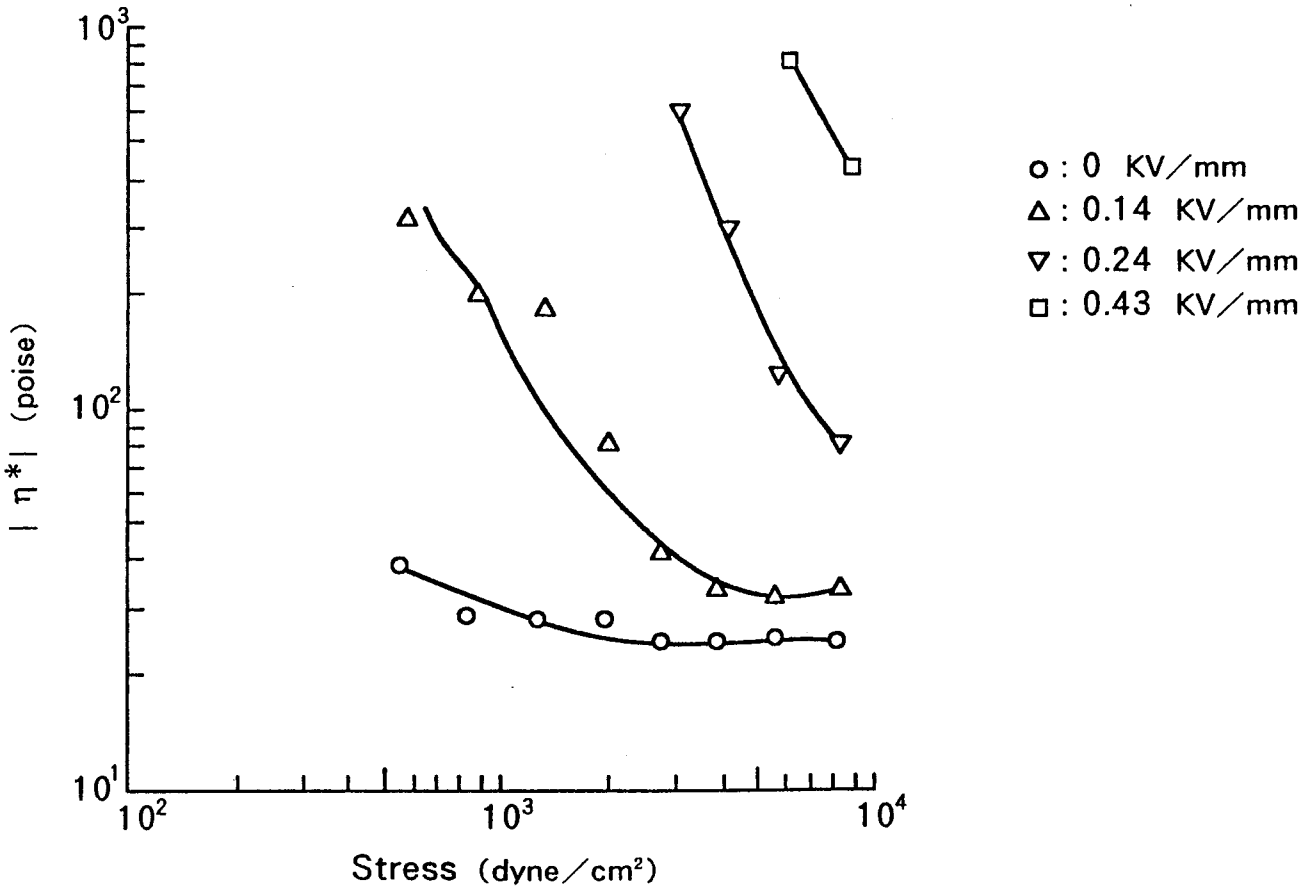
FIG. 1 is a graph showing the results of rheological measurements run on the electrorheological fluid composition obtained in Example 1 of this invention, with the vibrating stress applied to the composition plotted on the axis of abscissa and the absolute value of complex elastic modulus on the axis of ordinate.

This invention will be explained in detail below with reference to the accompanying examples and comparative examples, although not limited thereto.

EXAMPLE 1

A solution of 25 parts by weight of concentrated ammonia water (29%) in 100 parts by weight of ethanol was added to a solution of 3 parts by weight of tetraethoxysilane in 34 parts by weight of ethanol, mixed uniformly, and shaken at a rate of 120 times per minute at 20° C. for 24 hours. The silica particles formed were separated by filtration and dried in vacuum at 70° C. The yield was 2.44 parts by weight.

The silica particles thus prepared are hydrated silica as infrared spectroscopic analysis shows complete absence of absorptions due to the alkyl groups and elemental analysis indicates the presence of 0.9% by weight of carbon and 1.5% by weight of hydrogen. The particles are monodisperse spheres with a median diameter of 0.44 μm and a standard deviation of 0.26 μm as determined by centrifugal sedimentation. Their geometric surface area is 5.66 $m^2/g$. as calculated from the particle size distribution whereas their specific surface area is 6.7 $m^2/g$. as measured by the BET method with nitrogen as adsorbate, thus indicating that the silica particles synthesized as above are nonporous or dense. In thermogravimetric analysis, the silica particles suffer a weight loss of 7.0% with an endotherm, probably due to the loss of physically adsorbed water, in the temperature range up to 200° C. and a weight loss of 6.3% with a slight liberation of heat in the temperature range from 200° C. to 1,000° C.

The specific gravity of the hydrated silica particles thus obtained was taken as 2.2 and 7.5 parts by weight of the particles and 7.72 parts by weight of silicone oil (TSF 451-100 from Toshiba Silicone Co., Ltd., viscosity 1 poise) were mixed uniformly in an agate mortar to yield an electrorheological fluid composition containing 30% by volume of the silica particles.

The rheological measurement of this composition was made with the aid of a vibrating plate type rheometer. This equipment consists of a fixed stand and a parallel vibrating plate, a fluid specimen is placed between them, and the viscoelasticity of the specimen is measured from the displacement when a specified force is applied to vibrate the plate.

The electrorheological behavior was examined by dynamic measurement at a frequency of 45 Hz and a specimen film thickness of 40 to 75 μm by applying a voltage of 0 to 1 kV/mm. The viscoelasticity measurements on the dispersion system here indicate that the relationship of $G'<0.2\ G''$ ($G'$=dynamic modulus, $G''$=loss modulus) always holds regardless of strain and voltage, which means extreme smallness of the elastic effect. It was therefore decided to express all of the experimental results in the absolute value of complex elastic modulus $|\eta^*|(=|G^*|/\omega=[(G')^2+(G'')^2]^{0.5}/\omega$(where $|G^*|$ is the absolute value of complex elastic modulus and $\omega$ is the angular frequency).

The results are shown in FIG. 1. The stress-viscosity curve in the absence of an applied voltage is roughly horizontal, indicating extremely good fluidity.

On application of a voltage of 1 kV/mm, this electrorheological fluid composition changes into a gel completely devoid of fluidity within the experimental range and thus shows an extremely good electric response. The composition also shows good storage stability with virtually no precipitates forming when left standing at room temperature for 4 weeks.

COMPARATIVE EXAMPLE 1

A mixture of 30 parts by weight of water and 50 parts by weight of ethanol adjusted to a basicity of 1N by ammonia was added to a homogeneous mixture of 100 parts by weight of partial hydrolysates of tetraethoxysilane (pentamer on the average, Ethyl Silicate 40 from Nippon Colcoat Chemical Co., Ltd.) and 72 parts by weight of ethanol and was left standing at 50° C. for 48 hours to form a gel. The gel was dried at 50° C., ground, and dried in vacuum at 70° C. to yield silica particles to be used as xerogel for electrorheological fluid compositions.

The particles are porous with a specific surface area of 620 $m^2/g$. As determined by the BET method with nitrogen as adsorbate and a pore volume of 1.8 ml./g. In thermogravimetric analysis, the particles show a weight loss of 5.06% with an endotherm up to 200° C. and a weight loss of 8.0% with a vigorous exotherm about 200° C., suggesting the presence of a large amount of residual organic matters.

An attempt was made to prepare an electrorheological fluid composition containing 30% by volume of silica particles from the silica xerogel particles here and the silicone oil of Example 1, but it failed because of too much absorption of the oil by the silica particles.

COMPARATIVE EXAMPLE 2

The preparation of a fluid composition with a viscosity comparable to that of the one in Example 1 was tried using the silica xerogel particles of Comparative Example 1. It was possible to obtain a composition containing 6.7% by volume of the silica xerogel particles.

Figure 4:
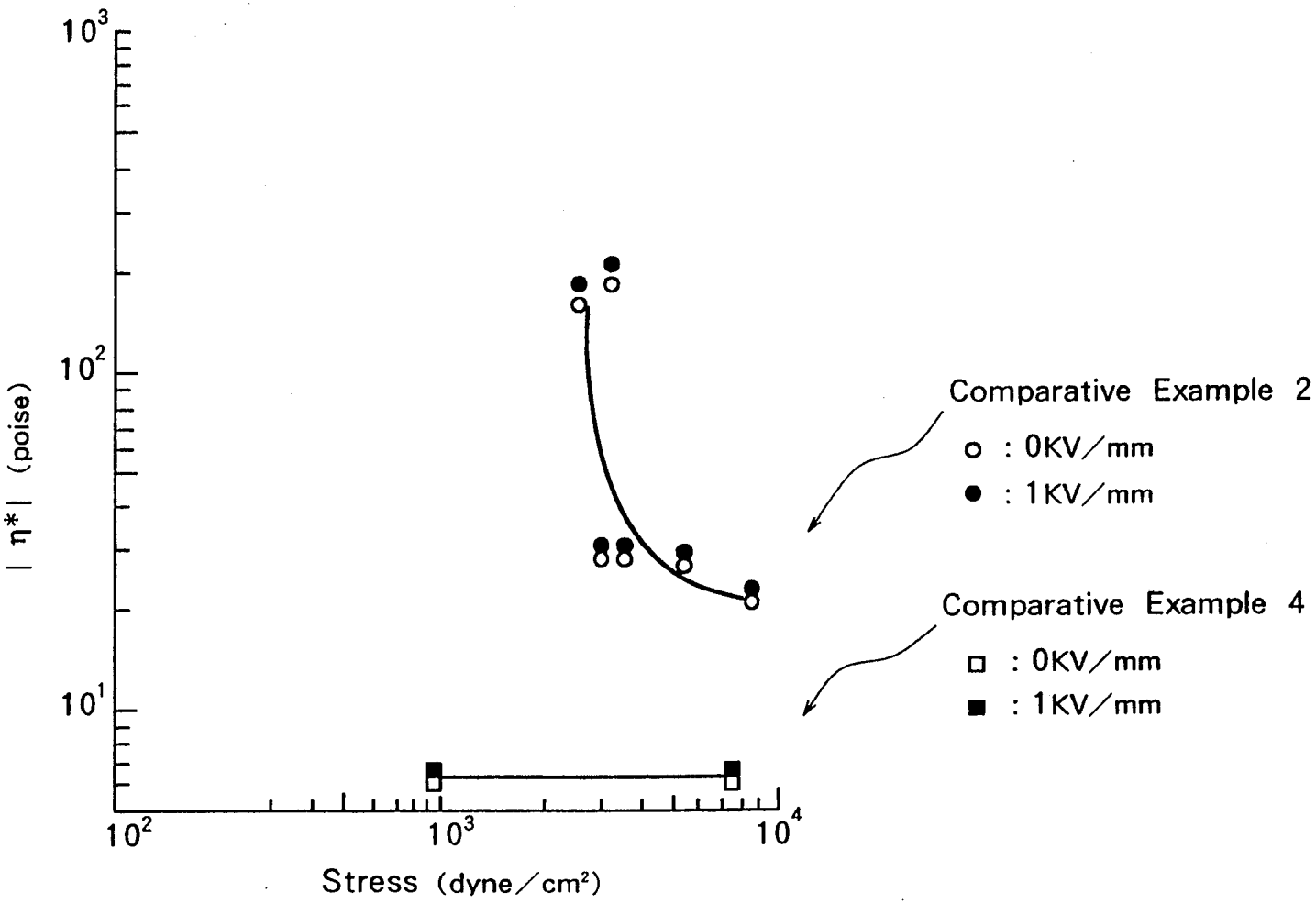
FIG. 4 is a graph showing the results obtained in Comparative Examples 2 and 4 in a manner similar to that in FIG. 1.

The electrorheological properties of the composition was evaluated with the aid of the rheometer of Example 1. The stress-viscosity curve is nearly identical in the presence or absence of an applied voltage of 1 kV/mm and some fluctuations due to thixotropy and practically no electrorheological effect were observed. The results are shown in FIG. 4.

COMPARATIVE EXAMPLE 3

An attempt was made to prepare an electrorheological fluid composition using ultrafine anhydrous silica particles synthesized in the vapor phase, namely Aerosil OX 50 from Nippon Aerosil Co., Ltd. This material has a specific surface area of 50 $m^2/g$. as determined by the BET method with nitrogen as adsorbate and shows a weight loss of 1.9% in thermogravimetric analysis up to 1,000° C.

An attempt to prepare an electrorheological fluid composition containing 30% by volume of silica particles from Aerosil OX 50 and the silicone oil of Example 1 failed because of too much absorption of the oil by the silica particles.

COMPARATIVE EXAMPLE 4

The preparation of a fluid with a viscosity comparable to that of the one in Example 1 was tried using Aerosil particles of Comparative Example 3. It was possible to prepare an electrorheological fluid composition containing 4.4% by volume of the Aerosil particles.

The electrorheological properties of the composition were evaluated with the aid of the rheometer of Example 1. The stress-viscosity curve is virtually the same in the presence or absence of an applied voltage of 1 kV/mm. The composition was practically a Newtonian fluid and produced virtually no electrorheological effect. The results are shown in FIG. 4.

COMPARATIVE EXAMPLE 5

The preparation of electrorheological fluid compositions was tried using commercial silica gel (product of Kanto Chemical Co., Inc. for chromatographic use). This material was observed in thermogravimetric analysis to lose 2.4% of its weight with an endotherm up to 200° C. and 3.5% of its weight above 200° C.

An attempt was made to prepare an electrorheological fluid composition containing 30% by volume of silica particles from this material and the silicone oil of Example 1, but it failed because of too much absorption of the oil by the silica particles.

COMPARATIVE EXAMPLE 6

The preparation of a fluid with a viscosity comparable to that of the one in Example 1 was tried using the silica particles of Comparative Example 5. It was possible to prepare an electrorheological fluid composition containing 11.8% by volume of the silica particles.

The electrorheological properties of the composition were evaluated with the aid of the rheometer of Example 1. The stress-viscosity curve was identical in the presence or absence of an applied voltage of 1 kV/mm, indicating the virtual absence of electrorheological effects. The fluid formed precipitates when left standing for one day, presenting a problem in respect to storage stability.

COMPARATIVE EXAMPLE 7

Silica particles were synthesized in the same manner as in Example 1 and dried at 600° C. for 12 hours. The particles have a BET specific surface area of 7.2 $m^2/g$. and there is no indication of the specific surface area having been reduced by sintering. In thermogravimetric analysis, the particles showed practically no weight loss with an endotherm up to 200° C. and a weight loss of 3.7% up to 1,000° C.

The specific gravity of the silica particles thus obtained was taken as 2.2 and 7.5 parts by weight of the particles and 7.72 parts by weight of silicone oil (TSF 451-100 from Toshiba Silicone Co., Ltd., viscosity 1 poise) were mixed uniformly in an agate mortar to prepare an electrorheological fluid composition containing 30% by volume of the silica particles.

The evaluation of the electrorheological properties of this fluid indicated that the stress-viscosity curve is practically the same in the presence or absence of an applied voltage of 1 kV/mm and virtually no electrorheological effect was observed.

EXAMPLE 2

The silica particles of Comparative Example 7, dried at 600° C. for 12 hours, were held in an atmosphere of high humidity at 70° C. and 85% relative humidity for 2 days. The particles thus treated were observed to show a weight loss of 4.2% with an endotherm up to 200° C. and a weight loss of 1.9% with practically no exotherm in the range from 200° C. to 1,000° C. in thermogravimetric analysis.

The specific gravity of the silica particles was taken as 2.2 disregarding adsorbed water and 7.5 parts by weight of the silica particles and 7.72 parts by weight of silicone oil (TSF 451-100 from Toshiba Silicone Co., Ltd., viscosity 1 poise) were mixed uniformly in an agate mortar to prepare an electrorheological fluid composition containing 30% volume of the silica particles.

Figure 2:
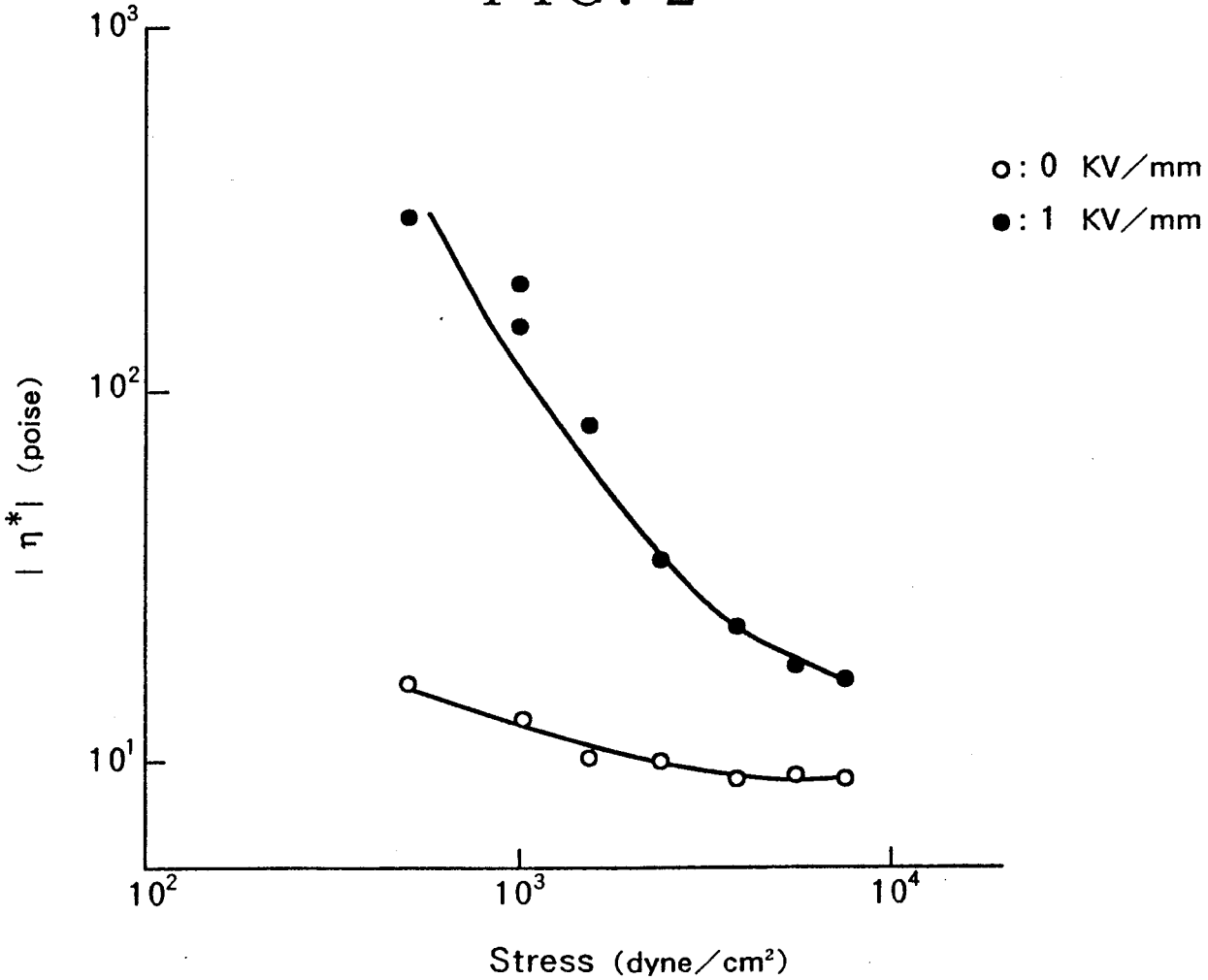
FIG. 2 is a graph showing the results obtained in Example 2 of this invention in a manner similar to that in FIG. 1.

The electrorheological properties were evaluated with the aid of the rheometer of Example 1. Contrary to Comparative Example 7 where virtually no electrorheological effect was observed, the composition here showed a distinct increase in viscosity on application of a voltage of 1 kV/mm or a good electrorheological effect as illustrated in FIG. 2.

EXAMPLE 3

Silica particles were synthesized as in Example 1 and the reaction medium was replaced with silicone oil to prepare an electrorheological fluid composition containing 45% by volume of the silica particles.

The procedure followed here was as follows.

A solution of 25 parts by weight of concentrated ammonia water (29%) in 100 parts by weight of ethanol was added to a solution of 8 parts by weight of tetraethoxysilane in 34 parts by weight of ethanol and the mixture was shaken at 20° C. for 24 hours at a rate of 120 times per minute to yield silica particles.

The reaction mixture containing the silica particles was concentrated under reduced pressure at 50° C., a mixture of 1.25 parts by weight of silicone oil and 100 parts by weight of tetrahydrofuran was added to the concentrate and dispersed ultrasonically, and the resulting homogeneous suspension was concentrated under reduced pressure at 50° C. until no more solvent distilled. In order to obtain a still more uniform electrorheological fluid composition, the procedure of addition of 100 parts by weight of tetrahydrofuran, ultrasonic dispersion, and solvent removal by distillation was repeated twice followed by drying in vacuum at 70° C. for 24 hours.

Figure 3:
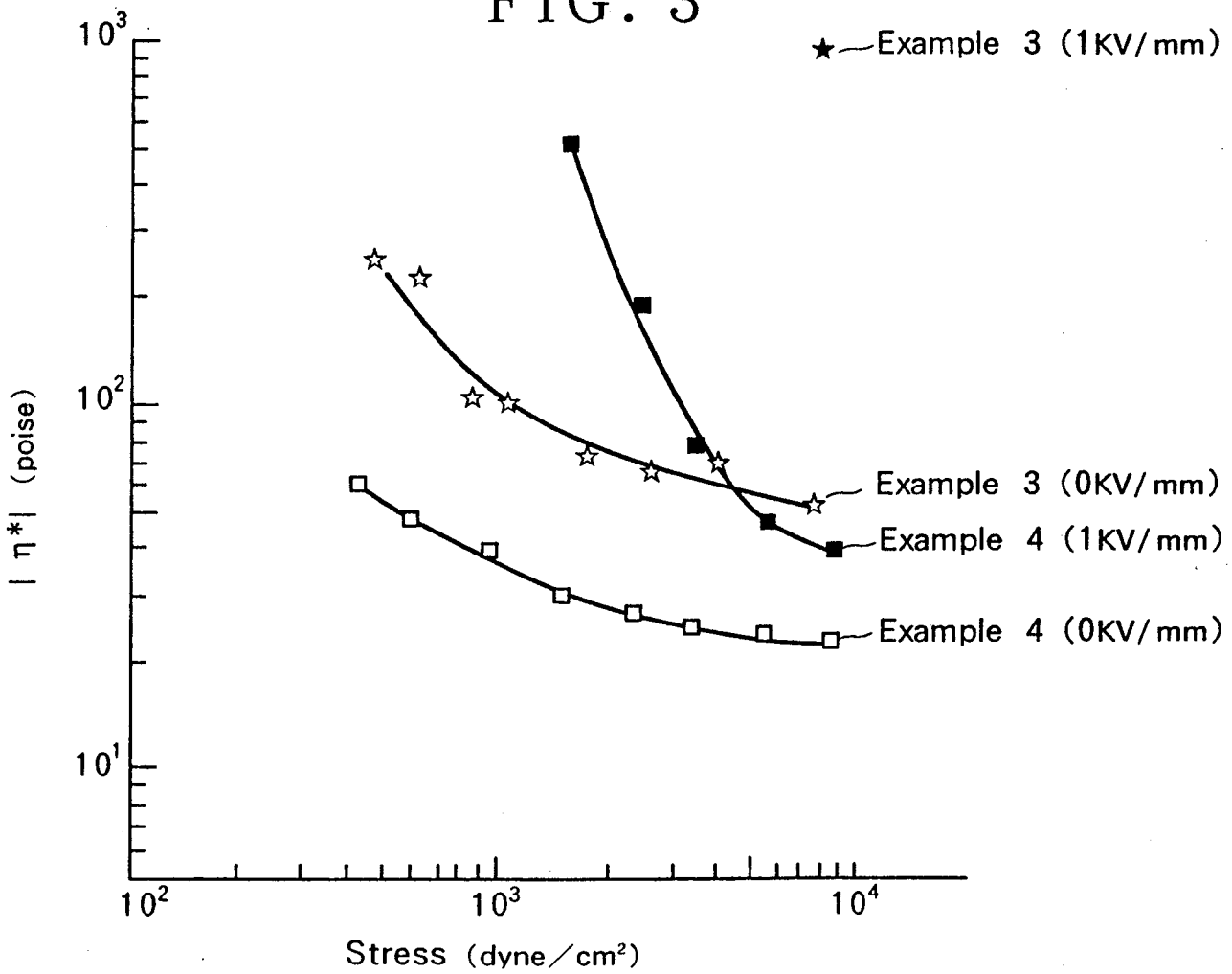
FIG. 3 is a graph showing the results obtained in Examples 3 and 4 of this invention in a manner similar to that in FIG. 1.

The electrorheological properties are shown in FIG. 3. The composition behaving as in FIG. 3 in the absence of an applied voltage changes into a gel devoid of fluidity on application of a voltage of 1 kV/mm. Thus, the composition here shows good electrorheological properties and also extremely good stability of the dispersed particles.

EXAMPLE 4

An electrorheological fluid composition containing 40% by volume of silica particles was prepared as in Example 3 and its electrorheological properties were measured. The results are shown also in FIG. 3. A marked increase in viscosity on application of a voltage of 1 kV/mm and extremely good stability of the dispersed particles indicate the formation of a good electrorheological fluid composition here.

What is claimed is:

1. An electrorheological fluid composition consisting essentially of an electrically nonconducting liquid and 10 to 50 vol. % silica particles dispersed therein, wherein the nonconducting liquid being at least one member selected from the group consisting of petroleum-derived lubricants, transformer oils, silicone oils, dibutyl sebacate, chlorinated paraffins, alkyl bromides, aromatic polycarboxylic acid alkyl esters, aromatic polycarboxylic acid halophenylalkyl esters, halophenyl alkyl ethers, and fluorine-containing oils and the silica particles being spherical particles formed by hydrolyzing a silicon alkoxide in a reaction mother liquor, the silicon alkoxide being of the following general formula (1)

$$Si(OR)_4 \quad (1)$$

in which R is an alkyl group in the presence of an alkali catalyst, and drying at or below 500° C. and the silica particles:

have an average diameter of 0.1–2.0 μm, have a BET nitrogen specific absorption area of $\leqq 100\ m^2/g$, have a carbon content of $\leqq 3\%$ and have a weight lose of 2–12% when heated up to 200° C. in thermogravimetric analysis and a weight lose of 2–10% when heated to 200° C. to 1000° C. in thermogravimetric analysis.

2. An electrorheolotical fluid composition according to claim 1 wherein said silica particles are separated from the reaction mother liquor of the hydrolysing step prior to the drying step.

3. An electrorheological fluid composition according to claim 1 wherein the reaction mother liquor of the hydrolyzing step is replaced by the nonconducting liquid prior to the drying step.

4. An electrorheological fluid composition consisting essentially of an electrically nonconductive liquid selected from the group consisting of petroleum-derived lubricants, transformer oils, silicone oils, dibutyl sebacate, chlorinated paraffins, alkyl bromides, aromatic polycarboxylic acid alkyl esters, aromatic polycarboxylic acid halophenylalkyl esters, halophenyl alkyl ethers, and fluorine-containing oils and silica particles dispersed therein in an amount of 10 to 50 vol. %, wherein the silica particles:

have an average diameter of 0.1–2.0 μm, have a BET nitrogen specific absorption area of $\leqq 100\ m^2/g$, and have a carbon content of $\leqq 3\%$.

5. An electrorheological fluid composition as defined in claim 4, wherein the amount of silica particles is 15–45 vol. %.

* * * * *